US008583015B2

(12) United States Patent
Ojima et al.

(10) Patent No.: US 8,583,015 B2
(45) Date of Patent: Nov. 12, 2013

(54) DEVELOPING DEVICE WITH A THICKNESS REGULATING MEMBER FOR REGULATING A THICKNESS OF A DEVELOPER ON A DEVELOPER CARRYING BODY AND IMAGE FORMING APPARATUS COMPRISING SAME

(75) Inventors: Seishi Ojima, Osaka (JP); Minoru Wada, Osaka (JP); Sayo Mabuchi, Osaka (JP)

(73) Assignee: Kyocera Mita Corporation (JP)

( * ) Notice: Subject to any disclaimer, the term of this patent is extended or adjusted under 35 U.S.C. 154(b) by 574 days.

(21) Appl. No.: 12/880,759

(22) Filed: Sep. 13, 2010

(65) Prior Publication Data

US 2011/0064485 A1 Mar. 17, 2011

(30) Foreign Application Priority Data

Sep. 16, 2009 (JP) ..... 2009-214270

(51) Int. Cl.
*G03G 15/09* (2006.01)

(52) U.S. Cl.
USPC ..... 399/274; 118/261

(58) Field of Classification Search
USPC ..... 399/274; 118/261
See application file for complete search history.

(56) References Cited

U.S. PATENT DOCUMENTS 4,566,402 A * 1/1986 Shimazaki ..... 399/284
4,615,608 A * 10/1986 Mizutani ..... 399/103
4,780,741 A * 10/1988 Wada et al. ..... 399/274

FOREIGN PATENT DOCUMENTS

JP 01-094370 4/1989
JP 2007-232841 9/2007

* cited by examiner

*Primary Examiner* — Walter L Lindsay, Jr.
*Assistant Examiner* — Ruth Labombard
(74) *Attorney, Agent, or Firm* — Gerald E. Hespos; Michael J. Porco; Matthew T. Hespos

(57) ABSTRACT

A developing device includes: a developer carrying body which supplies developer to a predetermined image carrying body; a layer thickness regulating member which is made of a magnetic material, which has a layer thickness regulating face opposing the developer carrying body so as to form a predetermined gap between the layer thickness regulating face and the developer carrying body and regulating the layer thickness of the developer on the developer carrying body, and which forms a magnetic path between the layer thickness regulating face and the developer carrying body; an installation member on which the layer thickness regulating member is installed; and an elastic sheet member arranged in the gap in a state of contact with a surface of the developer carrying body.

12 Claims, 6 Drawing Sheets

| | IMAGE DENSITY (IMAGE DEGRADATION) | SHEET DAMAGE |
|---|---|---|
| PRACTICAL EXAMPLE 3 | ◎ | ○ |
| PRACTICAL EXAMPLE 4 | ◎ | ○ |
| COMPARATIVE EXAMPLE 3 | × | — |

DEVELOPING DEVICE WITH A THICKNESS REGULATING MEMBER FOR REGULATING A THICKNESS OF A DEVELOPER ON A DEVELOPER CARRYING BODY AND IMAGE FORMING APPARATUS COMPRISING SAME

BACKGROUND OF THE INVENTION

1. Field of the Invention

The present invention relates to a developing device which forms a toner image on a predetermined image carrying body, and to an image forming apparatus including the same.

2. Description of the Related Art

An image forming apparatus, such as a copying machine, a printer, a facsimile device, or a composite of these, which employs an electrophotographic method includes a developing device that forms a toner image on an image carrying body (for example, a photosensitive drums or transfer belt) by supplying toner to the image carrying body.

The developing device includes, as basic constituent elements, a developer storing portion which stores developer composed of a non-magnetic toner and a magnetic carrier, a developing roller which receives developer from the developer storing portion and forms a toner image on the image carrying body by supplying the developer to the image carrying body, and a regulating blade, disposed so as to oppose the circumferential surface of the developing roller, and regulating the layer thickness of the developer on the circumferential surface of the developing roller.

In order to form a good toner image on the image carrying body, it is important to form a developer layer having a uniform thickness on the circumferential surface of the developing roller, by means of a regulating blade. A first prior art technology is known as technology for achieving a uniform thickness of the developer layer.

The developing apparatus according to the first prior art technology includes a regulating blade constituted by a magnetic plate which is disposed opposite the circumferential surface of the developing roller, and a non-magnetic elastic plate which is attached to the downstream surface of the magnetic blade as viewed in terms of the direction of rotation of the developing roller. When the developer adhering to the circumferential surface of the developing roller passes a gap formed between the regulating blade and the circumferential surface of the developing roller, firstly, the thickness of the layer of the developer is regulated magnetically by the magnetic plate and then the layer thickness is regulated physically by the elastic plate. In this way, it is possible to achieve uniform thickness of the developer layer using the magnetic plate and the elastic plate.

However, in the developing device according to the first prior art technology, the gap between one end of the magnetic plate and the circumferential surface of the developing roller is liable to vary with the dimensional accuracy of the magnetic plate, and the installation accuracy of the magnetic plate in the developing vessel. Therefore, although one end of the elastic plate projects further toward the developing roller than one end of the magnetic plate, if the dimensional accuracy of the magnetic plate or the installation accuracy of the magnetic plate in the developing vessel, or the like, is poor, then there will consequently be variation in the gap between one end of the magnetic plate and the circumferential surface of the developing roller. In this way, in the developing device according to the first prior art technology, variation is liable to occur in the gap through which the developer layer passes, and therefore the layer thickness cannot be made uniform. As a result of this, it is difficult to form a good toner image on the image carrying body.

SUMMARY OF THE INVENTION

The present invention has been devised in view of the aforementioned circumstances, an object thereof being to provide a developing device, and an image forming apparatus comprising the same, whereby it is possible to form a good toner image on an image carrying body by making the layer thickness of a developer layer uniform.

In order to achieve the aforementioned object, a developing device according to one aspect of the present invention includes: a developer storing portion storing a developer containing a magnetic carrier and a non-magnetic toner while stirring the developer; a developer carrying body receiving the developer from the developer storing portion and carrying the developer to supply the developer to a predetermined image carrying body while rotating in a predetermined direction; a layer thickness regulating member made of a magnetic material and having a layer thickness regulating face that opposes the developer carrying body with a predetermined gap formed between the layer thickness regulating face and the developer carrying body to regulate a layer thickness of the developer carried on the developer carrying body, the layer thickness regulating member forming a magnetic path between the layer thickness regulating face and the developer carrying body; an installation member on which the layer thickness regulating member is installed; and an elastic sheet member so disposed in the gap as to contact a surface of the developer carrying body.

Further objects of the present invention and further advantages obtained by means of the present invention will become apparent from the following description of the embodiments.

DESCRIPTION OF THE PREFERRED EMBODIMENTS

Below, an embodiment of the present invention is described in detail with respect to the drawings. In the following description, as one embodiment of the present invention, a monochrome printer is described as an image forming apparatus, but the present invention is not limited to this and can also be applied to an image forming apparatus, such as a copying machine, a facsimile device, or a composite machine combining these functions.

Figure 1:
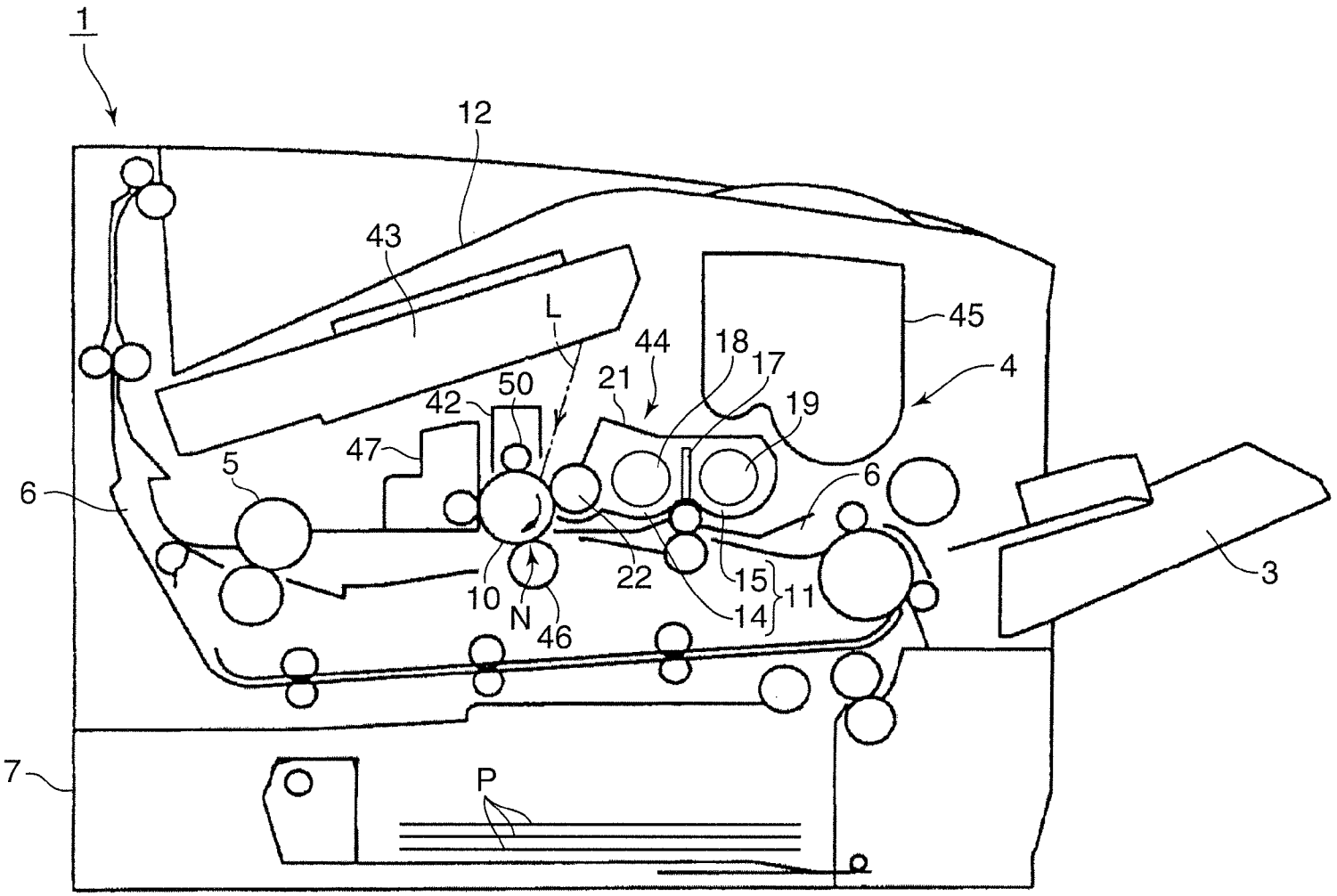
FIG. 1 is diagram showing a schematic view of the internal structure of an image forming apparatus.

FIG. 1 is a diagram showing a schematic view of the internal structure of an image forming apparatus. The image forming apparatus 1 includes an image forming unit 4 which forms a toner image on paper (sheet) P on the basis of image data from an external source (for example, a personal computer), a fixing unit 5 which fixes the toner image formed on the paper P, to the paper P, by applying heat, a paper supply cassette 7 which accommodates paper P, a paper output tray 12 to which paper P is output, a conveyance path 6 which conveys paper P to the paper output tray 12 from the paper supply cassette 7, passing via the image forming unit 4 and the fixing unit 5, a manual feed tray 3 provided in the right-hand face of the image forming apparatus 1 in FIG. 1, and an operating section (not illustrated) in which a plurality of menu setting keys, and the like, for menus of various types are arranged.

The image forming unit 4 includes a photosensitive drum (image carrying body) 10, a charging device 42 which performs a charging process of the photosensitive drum 10, an exposure device 43 which forms an electrostatic latent image by radiating laser light L onto the charged photosensitive drum 10, a developing device 44 which creates a toner image by electrostatically applying toner to the electrostatic latent image formed on the photosensitive drum 10, a toner cartridge 45 which supplies toner accommodated therein to the developing device 44, a transfer roller (transfer member) 46 which transfers the developed toner image to a paper P, and a toner removing device 47 which removes and recovers toner remaining on the surface of the photosensitive drum 10. When viewed in terms of the direction of rotation of the photosensitive drum 10 (the clockwise direction in FIG. 1), the charging device 42, the developing device 44, the transfer roller 46 and the toner removing device 47 are arranged in this order, following the circumferential direction of the photosensitive drum 10. Furthermore, the exposure device 43 is arranged above the charging device 42.

The photosensitive drum 10 is, for example, a drum having a photosensitive body created by vapor deposition of an amorphous silicon layer, which is a positively charged photosensitive body, onto the surface of an aluminum cylinder. The film thickness of the amorphous silicon layer and the linear velocity of the photosensitive drum 10 are set appropriately.

The charging device 42 includes a charging roller 50, for example. The charging roller 50 includes a metal core and an epichlorohydrin rubber layer which covers the metal core. Furthermore, the charging roller 50 employs a contact charging method wherein the circumferential surface of the roller 50 substantially makes point contact with the surface of the photosensitive drum 10, and the drum surface is charged to a uniform potential by applying a predetermined reference charging voltage (reference charging bias) including a mutually superimposed DC voltage and AC voltage, to the drum surface.

The charging device 43 has a polygon mirror (not shown) which directs laser light L based on image data input from an external PC (personal computer), or the like, onto the surface of the photosensitive drum 10. The polygon mirror forms an electrostatic latent image on the surface of the drum by scanning the surface of the photosensitive drum 10 with laser light L, while being rotated by a predetermined drive source. The developing device 44 forms a toner image on the surface of the drum by supplying toner to the electrostatic latent image.

The transfer roller 46 is pressed against the surface of the photosensitive drum 10 in the conveyance path 6 and a nip section N is formed between the transfer roller 46 and the drum surface. Since a voltage of opposite polarity to the surface potential of the drum surface is applied to the transfer roller 46, then the toner image on the drum surface is transferred to the paper P when the paper P passes through the nip section N. The paper P which has passed through the nip section N is conveyed to the fixing unit 5 via the conveyance path 6.

In the fixing unit 5, after the toner image on the paper P has been heated and fixed onto the paper P, the paper P is conveyed via the conveyance path 6 to the paper output tray 12.

Figure 2:
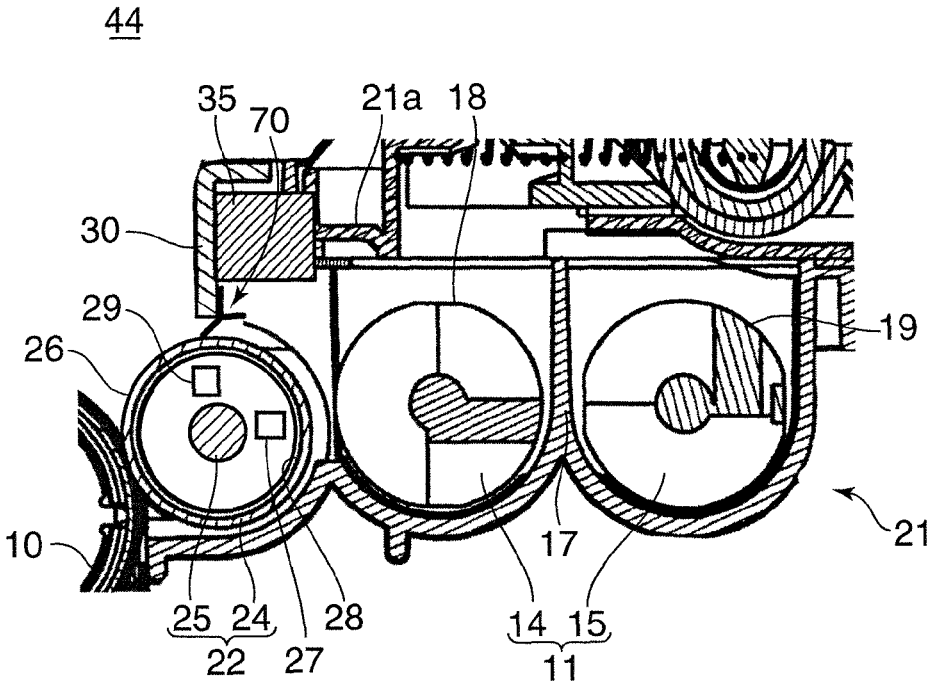
FIG. 2 is an enlarged diagram of a developing device relating to the present embodiment.

Below, the developing device 44 relating to the present embodiment is described in detail with reference to FIG. 1 and FIG. 2. FIG. 2 is an enlarged diagram of the developing device 44. The developing device 44 uses a two-component developer which is a mixture composed of a non-magnetic toner and a magnetic carrier, and as shown in FIG. 1 and FIG. 2, includes, as basic constituent elements, a developing vessel 21 which defines an internal space of the developing device 44, a developer storing portion 11 which is formed on the bottom wall of the developing vessel 21, and a developing roller 22 which is arranged at a developing opening of the developing vessel 21.

The developer storing portion 11 is constituted by two mutually adjacent developer storage chambers 14 and 15, which extend in the longitudinal direction of the developing device 44 (the direction perpendicular to the plane of the drawings in FIG. 1). The developer storage chambers 14 and 15 are divided from each other in the longitudinal direction by a dividing plate 17 made of a metal such as aluminum, for example, but are mutually connected at either end portion in the longitudinal direction.

Furthermore, screw feeders 18 and 19 which stir and convey the developer by rotation are installed rotatably in the developer storage chambers 14 and 15. The screw feeders 18 and 19 are set so as to have mutually opposite conveyance directions, and therefore the developer is stirred while being conveyed between the developer storage chamber 14 and the developer storage chamber 15. Due to this stirring, the non-magnetic toner and the magnetic carrier are mixed together and the toner becomes charged by the carrier. The developer storing portion 11 receives toner from the toner cartridge 45 via a replenishment port, which is not illustrated.

The developing roller (developer carrying body) 22 is a roller member including a tubular developing sleeve 24 made of a non-magnetic material such as aluminum and extending in the longitudinal direction of the developing device 44 (in other words, an axial direction of the photosensitive drum 10), and a rotating axle (not illustrated) which causes the developing sleeve 24 to rotate in the counter-clockwise direction in FIG. 2.

The developing sleeve 24 is arranged opposing the photosensitive drum 10 in a state where a gap of 0.2 mm to 0.4 mm is formed between an outer circumferential surface 26 of the developing sleeve and the surface of the photosensitive drum 10. A take-up pole 27 supported on a supporting shaft 25 is disposed inside the developing sleeve 24 in the vicinity of an inner circumferential surface 28 of the developing sleeve 24. The take-up pole 27 is arranged opposite the developer storage chamber 14, via the developing sleeve 24, and causes the developer in the developer storage chamber 14 to adhere magnetically to the outer circumferential surface 26 of the developing sleeve 24.

The developer on the outer circumferential surface 26 of the developing sleeve 24 is conveyed to the surface of the photosensitive drum 10 in accordance with the rotation of the developing sleeve 24, and adheres to the electrostatic latent image on the surface of the photosensitive drum 10 due to the potential difference between the developing bias applied to the developing sleeve 24 and the drum bias applied to the photosensitive drum 10. By this means, a toner image is formed on the drum surface, but in order to form a good toner image, the layer thickness of the developer caused to adhere to the outer circumferential surface 26 of the developing sleeve 24 by the take-up pole 27 must be made uniform before the developer becomes attached to the drum surface.

In the present embodiment, a developer regulating blade 30 and an elastic sheet member 70 are used as means for forming a developer layer of uniform layer thickness on the outer circumferential surface 26 of the developing sleeve 24.

Figure 3:
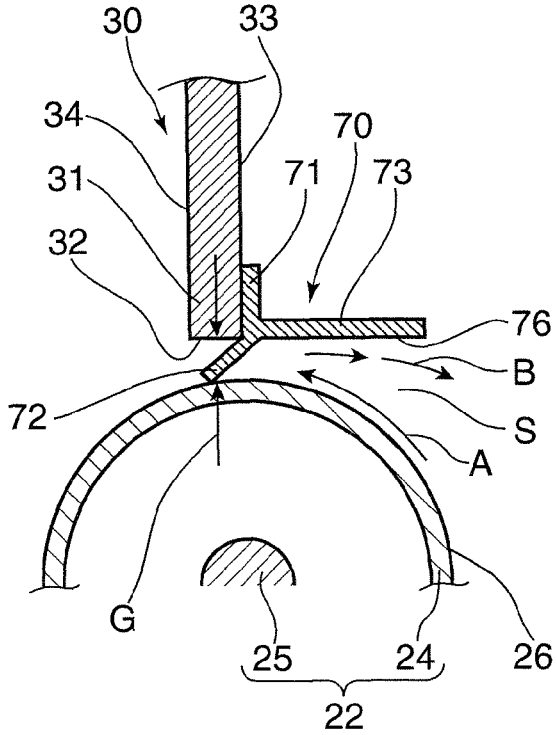
FIG. 3 is an enlarged diagram of a regulating means and the peripheral portion thereof in the developing device in FIG. 2.

The developer regulating blade (layer thickness regulating member) 30 is a plate-shaped member made of a magnetic material which is arranged above the developing roller 22 in FIG. 2 and extends along the axial direction of the developing sleeve 24. As shown in FIG. 3, the blade 30 has an end 31 which extends toward the outer circumferential surface 26 of the developing sleeve 24. The end 31 has an end surface (hereinafter, called layer thickness regulating surface) 32 which opposes the outer circumferential surface 26.

A gap G of a predetermined dimension is set between the layer thickness regulating surface 32 of the developer regulating blade 30 and the outer circumferential surface 26 of the developing sleeve 24. The supporting shaft 25 supports a regulating pole 29 (FIG. 2) composed of a magnet at a position opposing the layer thickness regulating surface 32. Therefore, a magnetic flux is created between the layer thickness regulating surface 32 and the regulating pole 29, and a magnetic path or so-called "magnetic shield" is formed between the two elements. The magnetic flux density between the layer thickness regulating surface 32 and the regulating pole 29 is increased by reducing the gap G or manufacturing the developer regulating blade 30 from a material having high magnetic properties. As described hereinafter, the developer regulating blade 30 magnetically regulates the layer thickness of the developer on the outer circumferential surface 26 of the developing sleeve 24 by means of the layer thickness regulating surface 32.

Furthermore, the developer regulating blade 30 is installed on the developing vessel 21. More specifically, the developing vessel 21 has a main body frame 21*a* constituting the developing vessel 21, and an installation member 35 is formed integrally with the main frame 21*a* at a suitable position. The developer regulating blade 30 is installed on the installation member 35 in such a manner that the layer thickness regulating surface 32 opposes the outer circumferential surface 26 of the developing sleeve 24 via a gap G.

The elastic sheet member 70 is a sheet member which is made from a material having elastic and non-magnetic characteristics. The elastic sheet member 70 includes a base end 71 which is supported on the developer regulating blade 30, a leading end 72 which is interposed in the gap G between the layer thickness regulating surface 32 and the outer circumferential surface 26, and an extension portion 73 which extends to an upstream side in terms of the direction of rotation of the developing sleeve 24.

Viewed in terms of the direction of rotation of the developing sleeve 24, the developer regulating blade 30 has an upstream face 33, on the upstream side of the direction of rotation, which faces toward the internal space of the developing vessel 21, and a downstream face 34, on the downstream side of the direction of rotation, which faces toward the exterior of the developing vessel 21. The base end 71 of the elastic sheet member 70 is fixed to the upstream face 33 of the developer regulating blade 30.

The leading end 72 extends toward the outer circumferential surface 26 of the developing sleeve 24 from a portion of the base end 71 on substantially the same plane as the layer thickness regulating surface 32, and is interposed in the gap G in a state of contact with the outer circumferential surface 26 of the developing sleeve 24. The elasticity of the elastic sheet 70 itself acts so as to urge the leading end 72 against the outer circumferential surface 26. As described hereinafter, the leading end 72 physically regulates the thickness of the developer layer on the outer circumferential surface 26 of the developing sleeve 24. In the following description, the leading end 72 is called a regulating end.

The extension portion 73 extends to the upstream side in terms of the direction of rotation of the developing sleeve 24 from a portion of the base end 71 on substantially the same plane as the layer thickness regulating surface 32. The extension portion 73 has an opposing face 76 which opposes the outer circumferential surface 26 of the developing sleeve 24. The opposing face 76 is set so as be gradually separated from the developing sleeve 24, toward the upstream side in the direction of rotation. In other words, the opposing face 76 is set in such a manner that the space S between the opposing face 76 and the outer circumferential surface 26 of the developing sleeve 24 gradually becomes larger, from the layer thickness regulating surface 32 of the developer regulating blade 30 towards the upstream side in terms of the direction of rotation of the developing sleeve 24. In the following description, the extension portion 73 is called a conveyance amount regulating portion, and the opposing face 76 is called a conveyance amount regulating face.

The base end 71, the regulating end 72 and the conveyance amount regulating portion 73 all extend in the axial direction of the developing sleeve 24, as well as extend through the whole of the width direction of the developer regulating blade 30 (in other words, the axial direction of the developing sleeve 24). Furthermore, the base end 71, the regulating end 72 and the conveyance amount regulating portion 73 are formed in a unified fashion. The conveyance amount regulating portion 73 may be a separate member which is formed from a different material than that of the elastic sheet member 70. In this case, the conveyance amount regulating portion 73 is constituted as a sheet-shaped member which is made of an ABS resin, for example, and is attached or bonded to the base end 71.

For the elastic sheet member 70, it is possible to use either a resin sheet, such as PET, acrylic, nylon, high-polymer PE, PPS, PI, or the like, or a rubber sheet, such as urethane, silicone, or the like.

In the developing device 44 having the composition described above, a developer layer having a uniform layer thickness is formed in the following way. The developer caused to adhere to the outer circumferential surface 26 of the developing sleeve 24 from the developer storage chamber 14 by the take-up pole 27 (FIG. 2) gradually approaches the conveyance amount regulating portion 73 of the elastic sheet member 70 in accordance with the rotation of the developing sleeve 24, as indicated by arrow A. The developer is conveyed to the space S between the conveyance amount regulating face 76 and the outer circumferential surface 26 of the developing sleeve 24, but the space S becomes narrower toward the downstream side of the direction of rotation of the developing sleeve 24. Therefore, a portion of the conveyed developer is gradually pushed back in a direction (arrow B) reverse to the direction of rotation of the developing sleeve 24 and caused to return to the developer storage chamber 14 by the conveyance amount regulating face 76. In this way, the amount of developer conveyed to the gap G is regulated by the conveyance amount regulating face 76. By this means, accumulation of large amounts of developer on the upstream side of the gap G in terms of the direction of rotation of the developing sleeve 24 is suppressed.

Figure 4A:
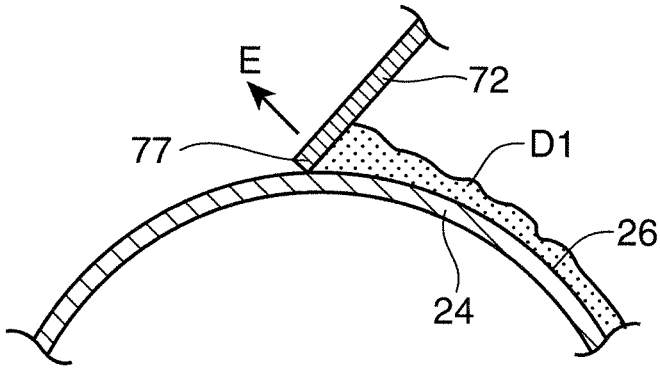
FIG. 4A is a schematic drawing for describing physical regulation of a developer layer by an elastic sheet member, showing a state before the developer layer is regulated.
Figure 4B:
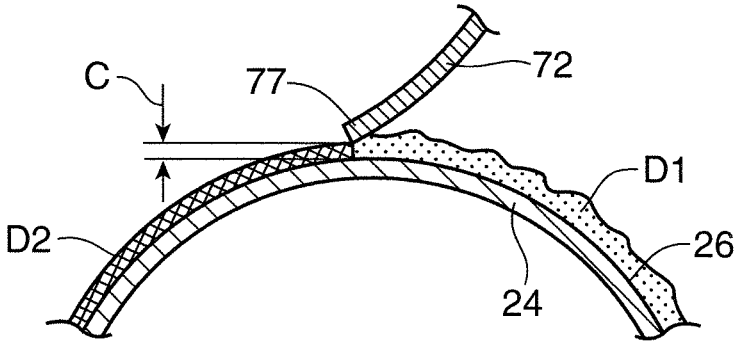
FIG. 4B is a schematic drawing for describing physical regulation of a developer layer by the elastic sheet member, showing a state after the developer layer has been regulated.

The developer on the outer circumferential surface 26 travels toward the gap G, while a portion thereof is pushed back by the conveyance amount regulating face 76, as described above. The developer layer D1 on the outer circumferential surface 26 strikes the regulating end 72 of the elastic sheet member 70, as shown in FIG. 4A, and the developer accumulates on the upstream side of the regulating end 72 as viewed in the direction of rotation of the developing sleeve 24. An edge portion 77, in particular, of the regulating end 72 does not deform until a predetermined amount of developer has accumulated, but if developer exceeding the predetermined amount accumulates, then the edge portion is pushed by this developer and deforms elastically (arrow E) so as to move away from the outer circumferential surface 26 of the developing sleeve 24. By this means, as shown in FIG. 4B, a gap C is created between the edge portion 77 of the regulating end 72 and the outer circumferential surface 26. The developer layer D1 is regulated physically by the edge portion 77 upon passing through the gap C, and a developer layer D2 having a uniform predetermined thickness is formed on the downstream side of the regulating end 72. The predetermined thickness of the developer layer D2 is substantially the same as the size of the gap C.

Furthermore, in the developing device 44, in addition to the physical regulation described above, magnetic regulation is also applied to the developer. More specifically, a magnetic shield is created in the gap G by a magnetic flux produced between the layer thickness regulating surface 32 of the developer regulating blade 30 and the regulating pole 29 of the developing roller 22. When the developer passes through the gap G, in other words, when the developer pushes up the edge portion 77 shown in FIG. 4A and FIG. 4B and passes through the gap C, the developer is regulated magnetically by the action of the magnetic shield. This magnetic regulation contributes to forming a developer layer D2 of a predetermined thickness.

In this way, in the developing device 44 relating to the present embodiment, the thickness of the developer layer is made uniform by both magnetic regulation by means of the developer regulating blade 30 and physical regulation by means of the elastic sheet member 70. Therefore, it is easy to form a good toner image on the surface of the photosensitive drum 10.

Furthermore, in the developing device 44, magnetic regulation by the developer regulating blade 30 and physical regulation by the elastic sheet member 70 are employed in combination. Therefore, even if it is difficult to regulate the thickness of the developer layer magnetically because of weakening of the magnetic regulating force produced by the developer regulating blade 30 due to variation in the gap G as a result of the dimensional accuracy of the developer regulating blade 30 or the installation accuracy of the developer regulating blade 30 on the installation member 35, or the like, since the elastic sheet member 70 (the regulating end 72) is arranged in the gap G in a state of contact with the outer circumferential surface 26 of the developing sleeve 24, it is possible to make the developer layer uniform by a physical action. Therefore, it is possible to form a good image on the image carrying body at all times.

Furthermore, since the conveyance amount regulating portion 73 is formed in a unified fashion with the elastic sheet member 70, then cost reductions can also be achieved.

Moreover, since the elastic sheet member 70 is made of a non-magnetic material, then there is no disruption of the magnetic shield formed between the developer regulating blade 30 made of a magnetic material and regulating pole 29. Therefore, the magnetic regulating force imparted to the developer by the developer regulating blade 30 is not impaired. By this means, the magnetic regulating force of the developer regulating blade 30 can contribute to forming the developer layer D2.

Next, Experiment 1 which was carried out using the developing device 44 relating to the present embodiment will be described. In this Experiment 1, change in amount of the magnetic brush (amount of developer) with respect to variation in the gap G was investigated. The experimental objects used were Practical Example 1 which includes both the developer regulating blade 30 and the elastic sheet member 70, and Comparative Example 1 which only includes the developer regulating blade 30. The results of Experiment 1 are shown in FIG. 5.

Figure 5:
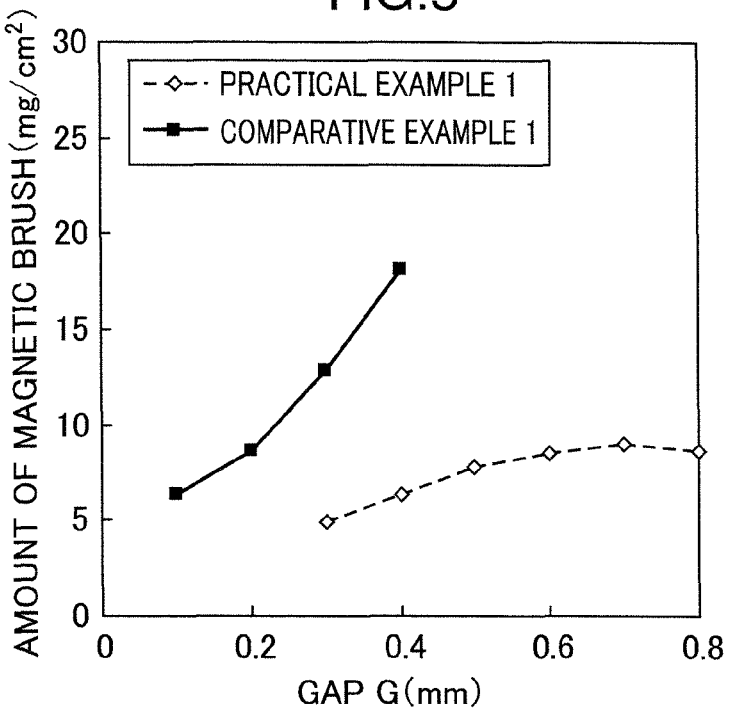
FIG. 5 is a diagram showing the results of experiments carried out in respect of change in the amount of developer with respect to variation in the gap between a developer regulating blade and a developing sleeve.

As FIG. 5 reveals, Practical Example 1 includes the elastic sheet member 70, and therefore compared to the Comparative Example 1 which does not include the elastic sheet member 70, there was little change in the amount of the magnetic brush, even if the gap G varied. In other words, in the case of Practical Example 1, even if the magnetic regulating force produced by the developer regulating blade 30 weakened due to increase in the gap G, it was still possible to suppress variation in the magnetic brush amount due to the physical regulating force produced by the elastic sheet member 70.

There follows a description of Experiment 2 which was carried out using the developing device 44 relating to the present embodiment. This Experiment 2 investigated change in BET specific surface area of toner in the developer with respect to the stirring time of the developer by the developer storage section 11. In Experiment 2, the experimental objects used were Practical Example 2 which includes the conveyance amount regulating portion 73 and a Comparative Example 2 which does not include the conveyance amount regulating portion 73. Furthermore, the BET specific surface area of the toner was expressed as a rate of change produced by stirring, taking the initial rate as a value of "1" at the start of stirring of the developer. The results of Experiment 2 are shown in FIG. 6.

Figure 6:
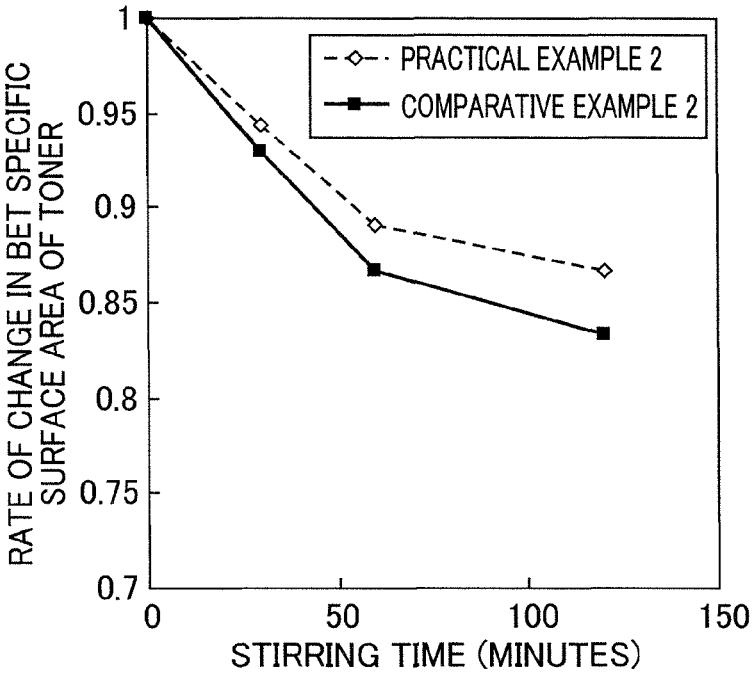
FIG. 6 is a diagram showing the results of experiments carried out in respect of change in the BET specific surface area of the toner with respect to the stirring time of the developer.

As FIG. 6 reveals, in Practical Example 2 which includes the conveyance amount regulating portion 73, there was little change in the BET specific surface area with respect to the stirring time of the developer, compared to Comparative Example 2 which does include the conveyance amount regulating portion 73. From this, it was discovered that when using the conveyance amount regulating portion 73, the adhesive force between the toner and the carrier was controlled suitably and the fluidity of the developer was not impaired, thus improving the durability of the developer.

Figure 7:
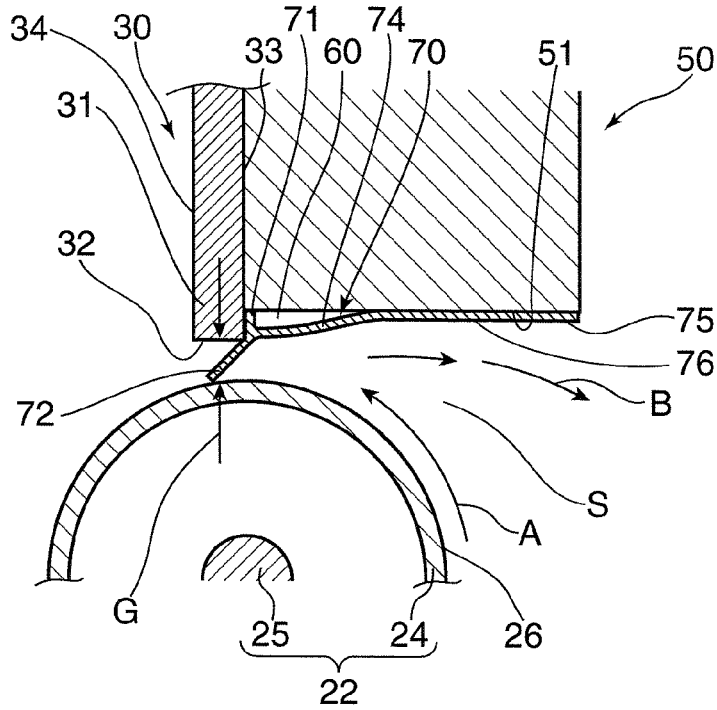
FIG. 7 is a diagram showing a modification example of the elastic sheet member.

Next, modification examples of the elastic sheet member 70 will be described with reference to FIG. 7 and FIG. 8. Firstly, the modification example of the elastic sheet member 70 shown in FIG. 7 will be described. In FIG. 7, the conveyance amount regulating portion 74 of the elastic sheet member 70 is extended further toward the upstream side in terms of the direction of rotation of the developing sleeve 24 than the conveyance amount regulating portion 73 shown in FIG. 2 and FIG. 3.

The conveyance amount regulating portion 74 is supported by a supporting member 50 which is formed integrally with the developing vessel 21. More specifically, the supporting member 50 has a supporting face 51 opposing the outer circumferential surface 26 of the developing sleeve 24, and the conveyance amount regulating portion 74 is installed on the supporting face 51 via a surface on the opposite side of the conveyance amount regulating face 76, at a position of the end 75 of the conveyance amount regulating portion 74, in other words, at a position of the most upstream portion of the conveyance amount regulating portion 74 in terms of the direction of rotation of the developing sleeve 24.

A space 60 extending toward the upstream side of the direction of rotation of the developing sleeve 24 is formed between the conveyance amount regulating portion 74 and the supporting face 51 of the supporting member 50. This space 60 can be formed by designing the shape of the supporting member 50 appropriately in such a manner that a step is formed between the layer thickness regulating surface 32 of the developer regulating blade 30 and the supporting face 51.

Due to the existence of this space 60, the conveyance amount regulating portion 74 is able to deflect toward the space 60 when pushing back the developer in the direction of arrow B in order to regulate the amount of developer conveyed to the gap G. By this means, it is possible to reduce the stress applied to the developer by the conveyance amount regulating face 76 of the conveyance amount regulating portion 74. Furthermore, since the conveyance amount regulating portion 74 regulates the conveyance amount of the developer while reducing the stress, it is possible to increase the durability of the elastic sheet member 70.

Figure 8:
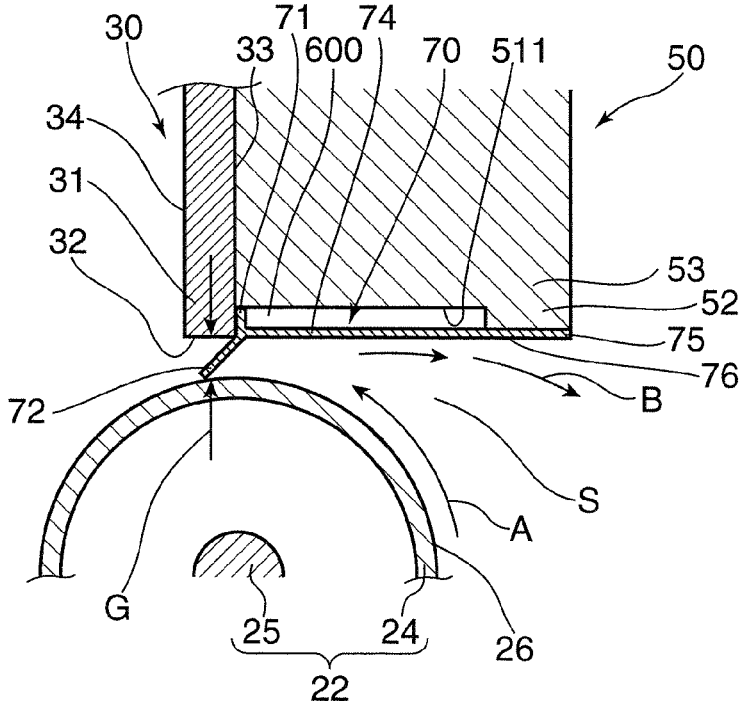
FIG. 8 is a diagram showing a modification example of the elastic sheet member.

In the modification example shown in FIG. 8, the most upstream portion of the supporting face 511 of the supporting member 50 when viewed in terms of the direction of rotation of the developing sleeve 24 is formed as a projecting portion 52 which projects toward the developing sleeve 24, in other words, toward the space S formed between the conveyance amount regulating portion 74 and the developing sleeve 24. The end 75 of the conveyance amount regulating portion 74 is fixed to the projecting portion 52.

In the modification example shown in FIG. 8, by forming the projecting portion 52, the space 600 formed between the conveyance amount regulating portion 74 and the supporting face 511 can be made larger than the space 60 in FIG. 7. By this means, the amount of deflection which the conveyance amount regulating portion 74 can deflect toward the space 600 when pushing back the developer is increased. As a result of this, it is possible further to reduce the stress applied to the developer by the conveyance amount regulating face 76 of the conveyance amount regulating portion 74.

In this way, by means of the elastic sheet member 70 shown in FIG. 7 and FIG. 8, the conveyance amount regulating portion 74 is extended further to the upstream side of the direction of rotation of the developing sleeve 24, in other words, the range of regulation is increased, and hence the capability of regulating the developer conveyance amount is improved and the stress imparted to the developer is reduced by the presence of the spaces 60 and 600.

Next, an Experiment 3 which was carried out using the developing device 44 shown in FIG. 7 and FIG. 8 will be described. This Experiment 3 investigated change in amount of magnetic brush (amount of developer) in relation to variation in the gap G. The experimental objects used in the experiment were: a Practical Example 3 including the conveyance amount regulating portion 74 that forms the space 60 between itself and the supporting face 51, a Practical Example 4 including the conveyance amount regulating portion 74 that forms the space 600 between itself and the supporting face 511, and a Comparative Example 3 which does not include the conveyance amount regulating portion 74. The results of Experiment 3 are shown in FIG. 9.

Figures 9, 10:
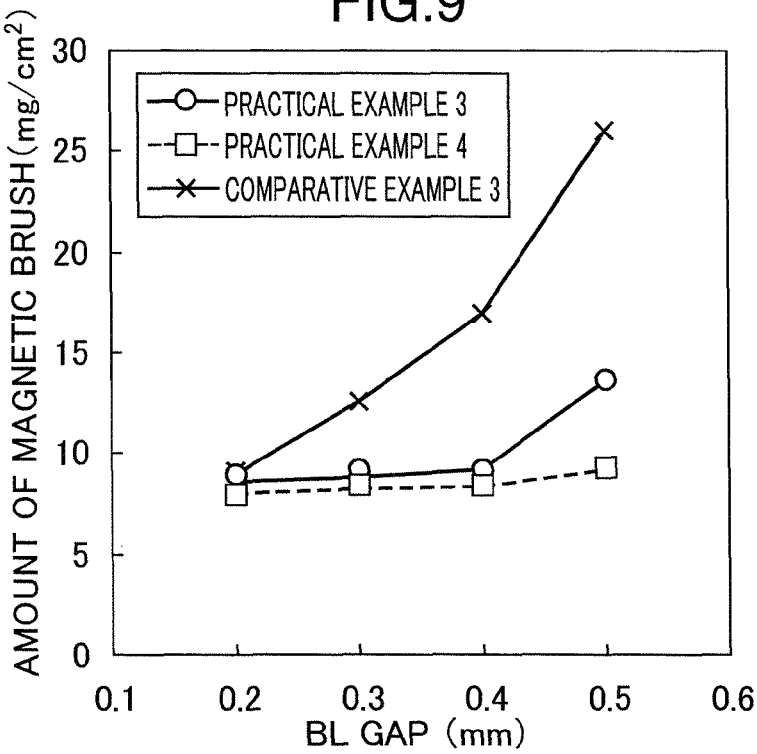
FIG. 9 is a diagram showing the results of experiments carried out in respect of change in the amount of developer with respect to variation in the gap between the developer regulating blade and the developing sleeve.
FIG. 10 is a diagram showing the results of experiments carried out in respect of image density of the toner image and the presence or absence of damage to the elastic sheet member.

As FIG. 9 reveals, because of the conveyance amount regulating portion 74, Practical Example 3 and Practical Example 4 showed small change in the amount of the magnetic brush, even in the event of variation in the gap G, compared to Comparative Example 3 which does not include the conveyance amount regulating portion 74. In particular, in Practical Example 3 and Practical Example 4, the magnetic brush amount was stable for a gap G of 0.3 mm to 0.4 mm, which is the value normally set. Furthermore, because the space 600 in Practical Example 4 is larger than the space 60 in Practical Example 3, in other words, because the amount of deflection of the conveyance amount regulating portion 74 is greater, then the magnetic brush amount was stable to a greater extent in Practical Example 4 than in Practical Example 3, in the case where the gap G exceeded 0.4 mm.

Moreover, in Practical Example 3, Practical Example 4 and Comparative Example 3, image density (image degradation) and damage to the elastic sheet member 70 were also investigated. The image density and sheet damage were examined after two hours' operation of the respective developing devices of Practical Example 3, Practical Example 4 and Comparative Example 3. The image density was evaluated on the basis of the measurement results obtained with a reflection densitometer. The reflection density was set to be 1.4 at the start of operation of the developing device. After two hours' operation, if the reflection density was 1.3 or above, the image density was evaluated as "good ◎", if the reflection density was 1.2 or above and less than 1.3, the image density was evaluated as "acceptable ○", and if the reflection density was less than 1.2, the image density was evaluated as "poor χ". Furthermore, sheet damage was assessed visually. If no damage to the sheet was observed, than an evaluation of ○ was awarded. The corresponding results are shown in FIG. 10.

Since Practical Example 3 and Practical Example 4 included the conveyance amount regulating portion 74, both had good image density, but Comparative Example 3 did not include the conveyance amount regulating portion 74 and therefore had poor image density. Furthermore, no sheet damage was observed in Practical Example 3 and Practical Example 4. From this, it can be seen that the presence of the spaces 60 and 600 contributes to the durability of the elastic sheet member 70.

The developing device 44 relating to the present embodiment was described above in relation to a case of application to a monochrome type image forming apparatus, but the developing device 44 can also be applied to a tandem type image forming apparatus.

This application is based on Japanese Patent application serial No. 2009-214270 filed in Japan Patent Office on Sep. 16, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device, comprising:

a developer storing portion storing a developer containing a magnetic carrier and a non-magnetic toner while stirring the developer;

a developer carrying body receiving the developer from the developer storing portion and carrying the developer to supply the developer to a predetermined image carrying body while rotating in a predetermined direction;

a layer thickness regulating member made of a magnetic material and having a layer thickness regulating face that opposes the developer carrying body with a predetermined gap formed between the layer thickness regulating face and the developer carrying body to regulate a layer thickness of the developer carried on the developer carrying body, the layer thickness regulating member forming a magnetic path between the layer thickness regulating face and the developer carrying body;

an installation member on which the layer thickness regulating member is installed; and an elastic sheet member so disposed in the gap as to contact a surface of the developer carrying body;

a conveyance amount regulating portion having a conveyance amount regulating face that is positioned more upstream than the layer thickness regulating face with respect to the direction of rotation of the developer carrying body and that is set to be gradually separated from the developer carrying body toward an upstream side with respect to the rotation direction of the developer carrying body to regulate an amount of the developer conveyed to the layer thickness regulating face, the conveyance amount regulating portion being an extension portion extended from the elastic sheet member towards the upstream side with respect to the rotation direction; and a supporting member having a supporting face that supports the extension portion, the extension portion being mounted on the supporting face to form a space between the extension portion and the supporting face, the space extending toward the upstream side with respect to the rotation direction of the developer carrying body, the space being formed by creating a step between the layer thickness regulating face of the layer thickness regulating member and the supporting face of the supporting member.

2. The developing device according to claim 1, wherein the elastic sheet member, when the developer is carried on the surface of the developer carrying body, deforms in a direction away from the surface of the developer carrying body so as to allow the developer of a predetermined layer thickness to be carried on the surface of the developer carrying body.

3. The developing device according to claim 1, wherein the supporting face has an upstream portion with respect to the rotation direction of the developer carrying body, the upstream portion being formed as a projecting portion projecting toward the developer carrying body, and the extension portion is mounted on the projecting portion.

4. The developing device according to claim 1, wherein the developer carrying body has a magnet forming the magnetic path between the magnet and the layer thickness regulating face, and the elastic sheet member is made of a non-magnetic material.

5. The developing device according to claim 1, wherein the elastic sheet member has a base end fixed to the layer thickness regulating member, and an end extending from the base end and positioned in the gap in a state of being elastically urged against the surface of the image carrying body, and the end deforms elastically in a direction away from the surface of the developer carrying body so as to allow the developer of a predetermined layer thickness to be carried on the surface of the developer carrying body when the developer on the developer carrying body passes the gap in accordance with the rotation of the developer carrying body.

6. The developing device according to claim 5, wherein the end has elasticity that allows the developer to contact the end and push the end up from the surface of the developer carrying body by a distance corresponding to the predetermined layer thickness when the developer passes the gap.

7. An image forming apparatus, comprising:

an image carrying body on which a toner image is formed;

a developing device forming the toner image on the image carrying body by supplying a toner to the image carrying body;

a transfer member transferring the toner image onto a sheet; and a fixing unit fixing the toner image on the sheet to the sheet, wherein the developing device includes:

a developer storing portion storing a developer containing a magnetic carrier and the non-magnetic toner while stirring the developer;

a developer carrying body receiving the developer from the developer storing portion and carrying the developer to supply the developer to a predetermined image carrying body while rotating in a predetermined direction;

a layer thickness regulating member made of a magnetic material and having a layer thickness regulating face that opposes the developer carrying body with a predetermined gap formed between the layer thickness regulating face and the developer carrying body to regulate a layer thickness of the developer carried on the developer carrying body, the layer thickness regulating member forming a magnetic path between the layer thickness regulating face and the developer carrying body;

an installation member on which the layer thickness regulating member is installed; and an elastic sheet member so disposed in the gap as to contact a surface of the developer carrying body a conveyance amount regulating portion having a conveyance amount regulating face that is positioned more upstream than the layer thickness regulating face with respect to the direction of rotation of the developer carrying body and that is set to be gradually separated from the developer carrying body toward an upstream side with respect to the rotation direction of the developer carrying body to regulate an amount of the developer conveyed to the layer thickness regulating face, the conveyance amount regulating portion being an extension portion extended from the elastic sheet member towards the upstream side with respect to the rotation direction; and a supporting member having a supporting face that supports the extension portion, the extension portion being mounted on the supporting face to form a space between the extension portion and the supporting face, the space extending toward the upstream side with respect to the rotation direction of the developer carrying body, the space being formed by creating a step between the layer thickness regulating face of the layer thickness regulating member and the supporting face of the supporting member.

8. The image forming apparatus according to claim 7, wherein the elastic sheet member, when the developer is carried on the surface of the developer carrying body, deforms in a direction away from the surface of the developer carrying body so as to allow the developer of a predetermined layer thickness to be carried on the surface of the developer carrying body.

9. The image forming apparatus according to claim 7, wherein the supporting face has an upstream portion with respect to the rotation direction of the developer carrying body, the upstream portion being formed as a projecting portion projecting toward the developer carrying body, and the extension portion is mounted on the projecting portion.

10. The image forming apparatus according to claim 7, wherein the developer carrying body has a magnet forming the magnetic path between the magnet and the layer thickness regulating face, and the elastic sheet member is made of a non-magnetic material.

11. The image forming apparatus according to claim 7, wherein the elastic sheet member has a base end fixed to the layer thickness regulating member, and an end extending from the base end and positioned in the gap in a state of being elastically urged against the surface of the image carrying body, and the end deforms elastically in a direction away from the surface of the developer carrying body so as to allow the developer of a predetermined layer thickness to be carried on the surface of the developer carrying body when the developer on the developer carrying body passes the gap in accordance with the rotation of the developer carrying body.

12. The image forming apparatus according to claim 11, wherein the end has elasticity that allows the developer to contact the end and push the end up from the surface of the developer carrying body by a distance corresponding to the predetermined layer thickness when the developer passes the gap.

* * * * *